US005839910A

United States Patent [19]

Meller et al.

[11] Patent Number: 5,839,910

[45] Date of Patent: Nov. 24, 1998

[54] COAXIAL CONNECTOR WITH IMPEDANCE CONTROL

[75] Inventors: Andrew Graham Meller, Vlijmen; Michel Gerardus Pardoel, ED Mierlo; Bernardus Lambertus Franciscus Paagman, Schijndel, all of Netherlands

[73] Assignee: Berg Technology, Inc., Reno, Nev.

[21] Appl. No.: 652,441

[22] PCT Filed: Nov. 29, 1994

[86] PCT No.: PCT/NL94/00300

§ 371 Date: Jul. 17, 1996

§ 102(e) Date: Jul. 17, 1996

[87] PCT Pub. No.: WO95/16292

PCT Pub. Date: Jun. 15, 1995

[30] Foreign Application Priority Data

Dec. 6, 1993 [NL] Netherlands ..... 9302115

[51] Int. Cl.[6] ..... H01R 29/00

[52] U.S. Cl. ..... 439/188; 439/944

[58] Field of Search ..... 439/188, 944, 439/607, 608, 620, 941; 200/51.1

[56] References Cited

U.S. PATENT DOCUMENTS

| | | | |
|---|---|---|---|
| 3,873,785 | 3/1975 | Lieberman | 200/51.1 |
| 4,674,809 | 6/1987 | Hollyday et al. | 439/92 |
| 5,076,797 | 12/1991 | Moulton | 439/188 |
| 5,222,149 | 6/1993 | Palmer | 381/94.6 |
| 5,234,353 | 8/1993 | Scholz et al. | 439/289 |
| 5,453,019 | 9/1995 | Garver et al. | 439/188 |

FOREIGN PATENT DOCUMENTS

| | | |
|---|---|---|
| 9215031 | 1/1993 | Germany . |

*Primary Examiner*—Neil Abrams
*Assistant Examiner*—Barry M. L. Standig
*Attorney, Agent, or Firm*—Daniel J. Long; M. Richard Page

[57] ABSTRACT

Coaxial connector provided with a body (20) of electroconductive material which extends in the casing (1) of the connector between the connection ends (18, 19) and is electrically separated therefrom. The body (20) functions as a capacitive coupling medium between the connection ends (18, 19) and thus influences the electrical connection impedance of the connector. Because a body of magnetic material (21) is accommodated at the same time, an inductive coupling can be provided and frequency-dependent impedance matching is possible.

12 Claims, 2 Drawing Sheets

COAXIAL CONNECTOR WITH IMPEDANCE CONTROL

BACKGROUND OF THE INVENTION

1. Field of the Invention

The invention relates to a coaxial connector provided with at least one electrical contact element having a contact side in the form of a coaxial inner and outer contact member for making contact with a further connector, and having a connection side in the form of connection ends, which extend from the inner and outer contact member, for connecting electrical wiring.

2. Brief Description of the Related Art

Coaxial connectors are in practice used on a large scale for radio-frequency (RF) connections in radio and television sets, telecommunication equipment such as telephone sets and the like. Two main groups can be distinguished, i.e. connectors for mounting on a printed-circuit board and cable connectors. In the case of the connectors for mounting on a printed circuit board, a further distinction can be drawn between connectors with connection ends for so-called surface mounting and connectors with connection ends for mounting in a hole in the board (the so-called through-mounting).

A special group is formed by the coaxial connectors provided with switching contacts. This usually involves connectors in which the inner contact member is composed of two switching contact elements. One switching contact element then functions as a contact member for making contact with a further connector, while the other switching contact element forms an auxiliary contact member. In the state where no external contact is made, the two switching contact elements are electrically connected to each other. This connection is automatically broken when contact is made with a further connector.

Connectors of this type are used, for example, in portable, wireless telephone sets which, in addition to their own built-in aerial, must be able to be connected to an external aerial, for example when used in a vehicle. In the state where no external contact is made, the transmission output of the telephone set is coupled, via the switching contact elements, with the aerial built into the set. In the state where external contact is made, the switching contact element, which functions as the inner contact member, connects the transmission output to an external aerial. Of course it is also possible for the outer contact member only or for both the inner and the outer contact member to be provided with switching contact elements.

As is known, care should be taken, when coupling RF coaxial wires, to ensure that the characteristic impedances of the members to be connected are substantially matched, in order to substantially limit losses resulting from reflections and the like. This obviously also applies to the connection elements employed, such as connectors and the like, which, in the case of mounting on a printed-circuit board, may be connected directly to, for example, the transmitting stage on the board.

Coaxial connectors provided with means for impedance control or matching are known from the prior art. See, for example, U.S. Pat. Nos. 3,873,785 and 4,749,968. In order to achieve a desired impedance, use is made of passive electronic components such as resistors, coils and capacitors which are accommodated in the connector casing. In addition to the fact that these components take up relatively large amounts of space, which has an adverse effect on the dimensions of the connectors, it is disadvantageous also from the assembly point of view to mount separate resistors, coils and the like in the connector casing and connect them electrically to the contact members in question.

A coaxial connector as described in the first paragraph of the description is known from U.S. Pat. No. 5,222,149. The known device is a damping terminator for suppressing spurious current flow in high fidelity audio frequency equipment. The termination element includes a conductive-film-covered ferromagnetic-core electrical damping element which is to be inductively coupled to potential signal carrying components.

SUMMARY OF THE INVENTION

The object of the invention is, in the first instance, to provide a coaxial connector having facilities for impedance control or matching, without the use of electronic components such as resistors, coils, capacitors and the like.

According to the invention, this object is achieved by there being disposed in the connector a body of electroconductive material which extends between the connection ends and is electrically separated therefrom, wherein the body of electroconductive material is provided with connection means for connecting further electrical wiring, said body acting as a capacitive coupling between the connection ends thereby influencing the electrical connection impedance of the connector.

The body of electroconductive material essentially acts as a capacitive coupling medium between the connection ends for the a.c. signals, or electrical signals which reverse polarity in a different manner, which are to be exchanged via the connector, and thus influences the electrical connection impedance of the connector. A direct electrically conducting connection of the body to the connection ends, as when using separate capacitors and the like, is unnecessary in the case of the connector according to the invention. The degree to which the electroconductive body influences the impedance depends, in a manner known per se, on the dimensions and the shape of the surfaces of the body and the connection ends, as well as on the distance therebetween. The medium (dielectric) situated between the confronting surfaces likewise affects the degree of capacitive coupling.

In a further embodiment of the coaxial connector according to the invention, in which the inner and/or outer contact member comprises switching contact elements which, in a first position, make electrical contact and, in a second position, are electrically separated, each provided with connection ends extending towards the connection side, the body of electroconductive material extends between the connection ends of the switching contact elements and is electrically separated therefrom.

In addition to the capacitive coupling already mentioned, this embodiment, in particular a version based thereon in which the body of electroconductive material is provided with a connection end for connecting electrical wiring, in particular the signal earth, is advantageous because mutual effective decoupling or, as the case may be, shielding of the switching contact elements is possible thereby. In the case of the above-described use for wireless telephones, it is thereby possible to prevent, in the case of a connected external aerial, transmission energy leaking away to the aerial built into the telephone set, which would mean a reduction in the range of the telephone when used in a car or the like. This apart from losses due to mismatching and the like. External interference signals which reach the switching contact elements are then likewise decoupled via the body in question.

In order to provide, in addition to a capacitive coupling, also a certain inductive coupling between the connection ends of the connector, there is arranged in the connector, in a still further embodiment of the invention, a body of magnetic material which extends between the connection ends and is electrically separated therefrom.

The magnetic material has an electrical effect comparable to an inductive element, such as a coil, connected in series to the connection ends or, as the case may be, the body of electroconductive material, but without the need for a direct electrical connection therewith. Especially in the case of telecommunication applications, the signals exchanged via the connector are in general of such low strength that only a functional magnetic coupling arises in the vicinity of the connection ends or, as the case may be, the electroconductive body, so that there is no risk of undesirable radiation effects.

The degree of inductive coupling depends, inter alia, on the length over which the connection ends and/or the electroconductive body are surrounded by the magnetic material and on the type of magnetic material. In order to substantially limit the hysteresis losses in the magnetic material, which arise under the influence of the a.c. signals, and in order to achieve, for signals of relatively low strength, a connection or terminal impedance independent of the signal strength, the use of magnetically soft material is preferred, preferably magnetic material having a high initial permeability, in particular ceramic magnetic material or ferrite. One embodiment of the invention, which is advantageous in terms of assembly, is that in which the body of electroconductive material and the body of magnetic material are combined to form a single entity.

For the purpose of retaining the body of electroconductive material in the casing, the body of magnetic material or a combined body, an embodiment of the connector according to the invention has connection ends designed as strips, with elements which are raised with respect to the plane thereof and in the assembled state of the connector engage a relevant body.

An effective retaining action and, if required, accurate positioning of the body to be disposed between the connection ends are achieved, in one embodiment of the invention, by the raised elements being lip-shaped and extending at an angle with respect to the associated plane, each having a fixed resilient end and a raised free end, which free end in the assembled state engages the body in question, preferably in guide slots or guide grooves formed for receiving therein the lip-shaped elements.

The raised elements can be punched as a whole from the strip-shaped connection ends. The body of electroconductive material may likewise comprise a strip-shaped conductor with elements which are raised with respect to the plane thereof for retaining the electrical conductor in a duct in the material surrounding the conductor.

Especially for use in combination with a portable telephone set, according to an embodiment of the invention wherein the coaxial connector is provided with a casing of electrically insulating material, there are accommodated in the casing, in addition to one or more coaxial contact elements, also plug and/or socket contact elements. Via this plug and socket contact elements it is then possible to exchange external supply and other non-radio-frequency signals.

The coaxial connector according to the invention may be assembled in a simple manner, because direct electrical connections with the connections ends of the contact elements are unnecessary. Consequently the invention also provides a method for assembling a coaxial connector as described hereinabove, provided with a casing of electrically insulating material, the body being disposed in a first step between the connection ends of the contact members in question, and in a further step the assembly, thus formed, of contact members and body being accommodated from the connection side in the casing of the connector.

BRIEF DESCRIPTION OF THE DRAWINGS

The invention is described below in more detail with reference to a drawn embodiment of a coaxial connector provided with switching contact elements.

DETAILED DESCRIPTION OF THE PREFERRED EMBODIMENTS

Figure 1:
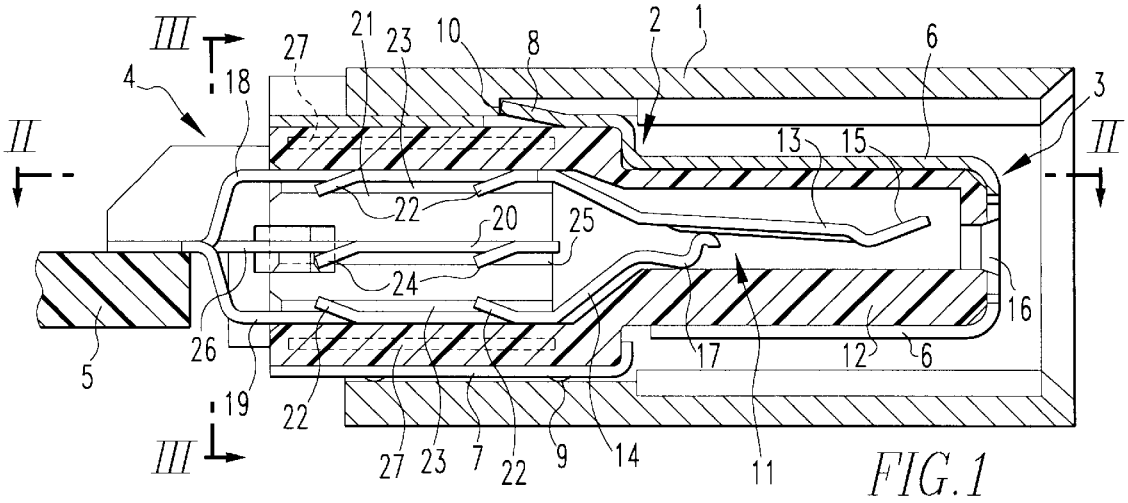
FIG. 1 shows, in diagrammatic form, a longitudinal section through a coaxial connector according to the invention, suitable for mounting on a printed circuit board.

The embodiment of the connector according to the invention depicted in FIG. 1 is of the socket type, provided with switching contact members, for mounting on a printed-circuit board.

The connector comprises a casing 1 of electrically insulating material, provided with a coaxial contact element 2 with a contact side 3 for making contact with a further connector, and a connection side 4 for mounting on a printed circuit board 5.

The contact side 3 is formed by an outer contact member 6 in the form of a cylindrical sleeve of electroconductive material, which extends and flares out towards the connection side 4 and is provided with a connection end 7 terminating in a soldering end for surface mounting on the printed-circuit board 5. For the purpose of retaining the coaxial contact element 2 in a clamping manner in the casing 1, the outer contact member 6 may be provided with a lip 8 and protuberances 9, the lip 8, in the mounted state, engaging with its free end on a stop 10 formed in the casing. The casing 1 may, however, alternatively engage the connection end 7 in a clamping manner in order to retain same by a sufficient frictional force.

An inner contact member 11 extends coaxially within the outer contact member 6 from the connection side 3. The inner contact member 11 and the outer contact member 6 are arranged to be electrically separated from each other by means of a body 12 of electrically insulating material. The inner contact member 11 consists, in the embodiment shown, of a first switching contact element 13 and a second switching contact element 14. The first switching contact element 13 has a contact end 15 which adjoins a receiving opening 16 in the body 12 for making contact with the inner contact member of a further coaxial connector (not shown). The second switching contact element 14 is provided with a contact end 17 which is situated in the casing 12 at a distance from the receiving opening 16. The two switching contact elements 13, 14 are provided with connection ends 18 and 19, respectively, which terminate in soldering ends for surface mounting on the printed circuit board 5. In the position where external contact is not made, or rest position, shown in FIG. 1, the two switching contact elements 13, 14 make electrical contact with each other.

In accordance with the invention there is situated, in the region of the connector between the connection ends 18, 19 of the two switching contact elements 13, 14, a body 20 of electroconductive material which, in the embodiment shown, is surrounded by a sheath 21.

Figure 2:
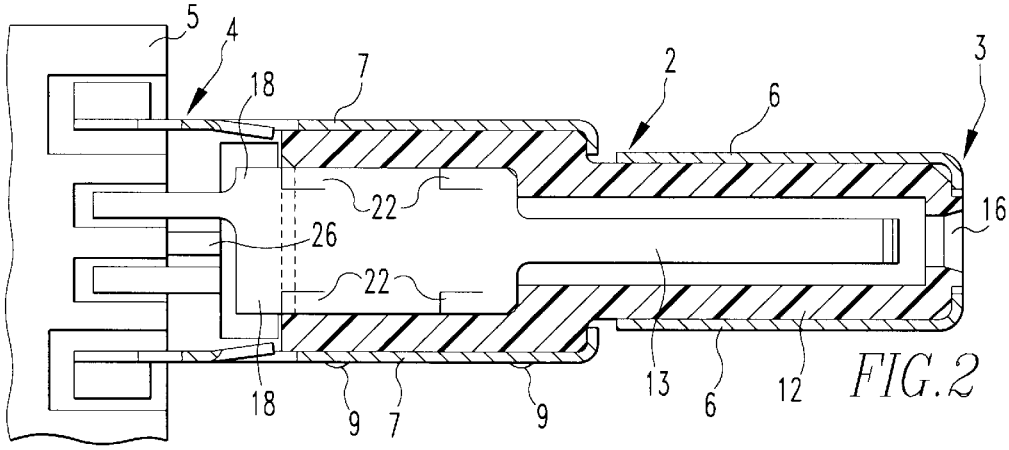
FIG. 2 shows, in diagrammatic form, a section along the line II—II of the connector depicted in FIG. 1, without casing.
Figure 3:
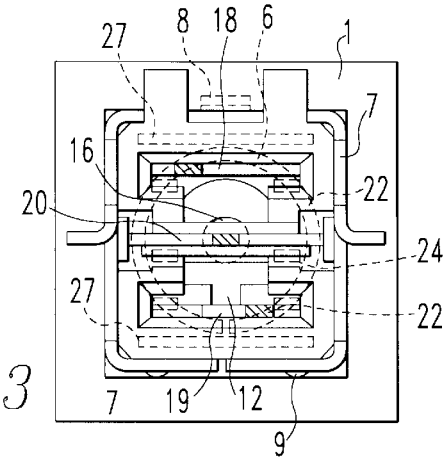
FIG. 3 shows, in diagrammatic form, a view along the line III—III of the connector depicted in FIG. 1, without casing.

As can be seen clearly in the sectional view, depicted in FIG. 2, along the line II—II in FIG. 1, those sections of the connection ends 18, 19 of the switching contact elements 13, 14 which are located in the connector are constructed in the form of strips, and in particular as opposite flat plate sections between which the electroconductive body 20 extends, the latter being likewise strip-shaped, and in particular formed as a flat plate 20, which can be seen in the view, depicted in FIG. 3, along the line III—III in FIG. 1.

For the purpose of retaining the body 20 or, as the case may be, the sheath 21, between the connection ends 18, 19 in the connector, the connection ends 18, 19 are provided with lips 22 which, with their free end, engage the sheath 21 which to this end is preferably provided with slots 23. The plate-shaped body 20 of electroconductive material is provided in a similar manner with lips 24 which engage in a duct 25 in the sheath 21 thereon. The body 20 is further provided with a connection end 26 for connection to the printed-circuit board 5.

As can be seen clearly from FIG. 1, the electroconductive body 20 in conjunction with the connection ends 18 and 19, respectively, forms plate capacitors, the capacitive coupling mainly being a function of the area of the opposite plate sections, the spacing therebetween and the material which is present between the plate portions. In radio-frequency applications, in particular, this capacitive coupling affects the impedance which is perceived by an electrical signal from the connection side 4 of the coaxial contact element.

Connecting the connection end 26 of the plate-shaped body 20 to, for example, the signal earth achieves, in the state where contact is made with a further connector and the electrical connection between the two switching contact elements 13, 14 being broken, a shielding effect between the two switching contact elements 13, 14. This supplementary shielding effectively prevents crosstalk between the electrically separated switching contact elements 13, 14, which may arise especially in radio-frequency applications. External interference signals which reach the connection ends 18, 19, in particular the section protruding outside the casing 1, are then likewise diverted to the signal earth via the capacitively coupled electroconductive body 20. It will be evident that this promotes reliable functioning of the apparatus connected via the coaxial connector according to the invention.

As diagrammatically indicated by dashed lines in FIG. 1, it is also possible to arrange a body of electroconductive material 27 between the connection ends 18, 19 and the connection end 7 of the outer conductor 6. The body 27 may, for example, entirely envelop the connection ends 18, 19 or may be composed of separate loose parts, provided, if desired, with a connection end for mounting on the printed circuit board 5. Such an electroconductive body 27 likewise results in an effect on the capacitive coupling between the inner conductor 11 or, as the case may be, the switching contact elements 13, 14, and the outer conductor 6, owing to which impedance matching is again possible. The body 27 may, in a similar manner to the body 20, be retained by means of lips in a duct formed in the body 12 (not shown).

In addition to a body 20 with sheath 21, or a body 27 of electroconductive material, respectively, it is also possible to accommodate a body of magnetic material between the respective connection ends for the purpose of varying the impedance via inductive coupling. Ceramic, ferrimagnetic material is found to be particularly suitable for this purpose. Soft magnetic ferrite material which has both a high initial permeability and a high electrical resistance is manufactured by powder pressing followed by sintering. Such a body may, for example, be constructed in the form of the jacket 21 and be retained therebetween by means of the lips 22 of the connection ends 18, 19.

In combination with an electroconductive body 20, the sheath 21 being made of magnetic material, a partial capacitive and inductive coupling is possible by means of which, for example, the impedance of the connector can be accurately tuned for certain frequency ranges. By using weakly electroconductive material, an additional resistive coupling can be accomplished if desired.

The coaxial connector according to FIG. 1 can be assembled in a simple manner by accommodating, in a first step, the electroconductive body 20 with its sheath 21 and/or a correspondingly shaped body of magnetic material of the same dimensions between the connection ends 18, 19 of the switching contact elements 13, 14 and then introducing the whole in a clamping manner into the body 12 from the connection side 4 of the connector, whereupon the thus assembled entity can be accommodated in the casing 1.

Instead of a coaxial connector for mounting on a printed-circuit board, as described and illustrated in the above, in particular for the technique of surface mounting, the principle of the invention can also be applied to so-called cable connectors, where the connection ends 18, 19 are provided with suitable connection terminals for mounting electrical cables. Connection techniques suitable for this purpose are known per se in practice. It is of course also possible to mount the connector via a pin/hole connection on a printed-circuit board instead of by the surface mounting technique shown.

It will be evident that the principle of the invention can also be applied to coaxial connectors provided with a pin-shaped or socket-shaped inner contact member. The body of electroconductive and/or magnetic material according to the invention then extends between the connection ends of the inner contact member in question and the outer contact member of the coaxial connector, all this in accordance with the body 27, indicated in FIG. 1 with dashed lines in the case of an electrical conductor, and, for example, the use of a magnetic body 12 in the case of an inductive coupling. Here, again, of course, combinations of the two are conceivable.

Figure 4:
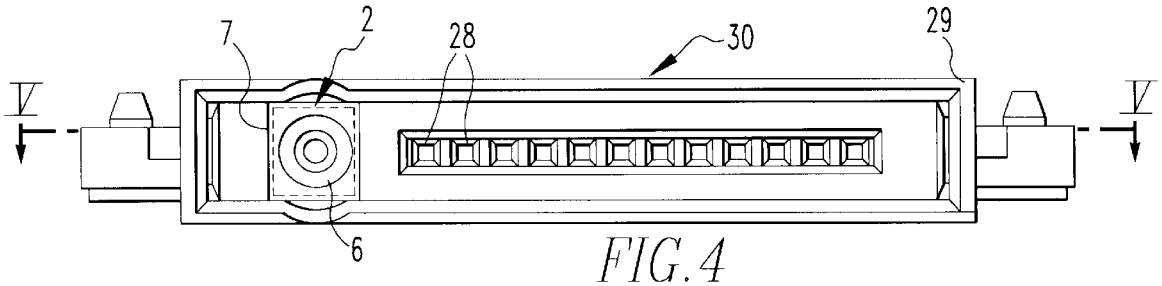
FIG. 4 shows, in diagrammatic form, a view of the contact side of a coaxial connector according to the invention, provided with a casing in which a plurality of plug and/or socket contact elements are accommodated.
Figure 5:
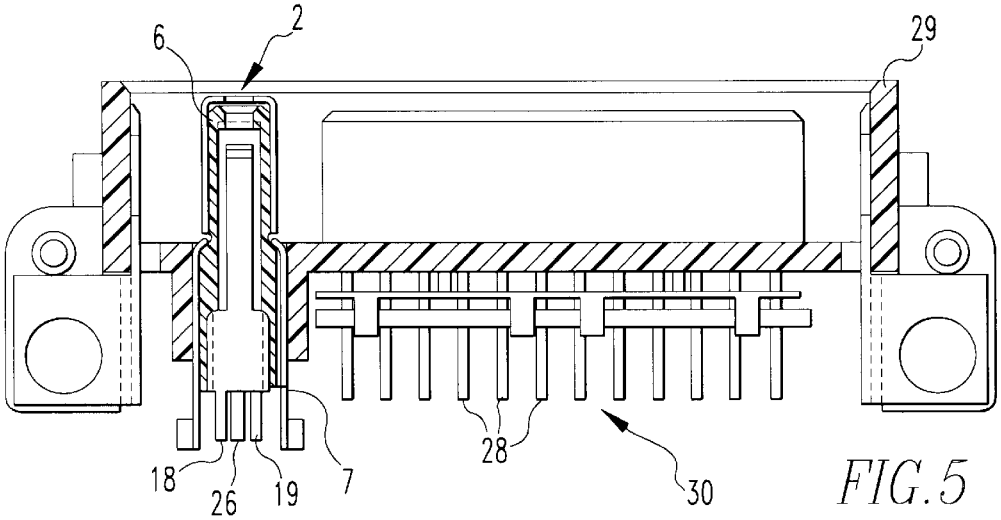
FIG. 5 shows, in diagrammatic form, a section along the line V—V of the connector depicted in FIG. 4.

FIG. 4 shows the view of the contact side of a coaxial connector 30 according to the invention, in which, in addition to a coaxial contact element 2, a plurality of plug and/or socket contact elements 28 are accommodated in a common casing 29. FIG. 5 shows a section along the line V—V in FIG. 4.

A connector of this type is suitable, in particular, for use in wireless equipment where it is necessary, in addition to a radio-frequency link, for example for connecting an external aerial, also to exchange supply and control signals with the apparatus in question.

FIG. 6 shows an example of a wireless telephone 31 provided with a built-in aerial 32 and a transmitting stage 37 which can be connected, via a connector 30 according to the invention and a further connector 33, to an external aerial 34 of, for example, a car 35. Via the contact elements 28 of the connector 30 it is possible to make connections, via lines 36, to a microphone, loudspeaker supply and other peripheral equipment such as a modem, fax and the like.

The invention is, of course, not limited to the application described in the above for a wireless telephone but can be employed in all those cases where a coaxial connector with options for impedance matching and/or improved shielding against internal or external interference signals is necessary or desirable.

We claim:

1. Coaxial connector provided with at least one electrical contact element having a contact side in the form of a coaxial inner and outer contact member for making contact with a further connector, and having a connection side in the form of connection ends, which extend from the inner and outer contact member, for connecting electrical wiring, there is disposed in the connector a body of electroconductive material which extends between the connection ends and is electrically separated therefrom and the body of electrocondcutive material consists of at least one electrical conductor surrounded by electrically non-conductive material and the body of electroconductive material is plate-shaped.

2. Coaxial connector according to claim 1, wherein the inner and/or outer contact member (11, 6) comprises switching contact elements (13, 14) which, in a first position, make electrical contact with each other and, in a second position, are electrically separated, each provided with connection ends (18, 19) extending towards the connection side (4), the body of electroconductive material (20) extends between the connection ends (18, 19) of the switching contact elements (13, 14) and is electrically separated therefrom.

3. Coaxial connector according to claim 1, wherein the body connection means comprise a connection end (26) extending towards the connection side.

4. Coaxial connector according to claim 1, wherein there is disposed in the connector a body of magnetic material which extends between the connection ends and is electrically separated therefrom.

5. Coaxial connector according to claim 4, wherein the body of electroconductive material (20) and the body of magnetic material are combined to form a single entity.

6. Coaxial connector according to claim 5, wherein the combined body consists of an electrical conductor surrounded by magnetic material.

7. Coaxial connector according to claim 1, wherein the connection ends are strip-shaped and have a plane and have elements which are raised with respect to the plane of said connection ends such that, in the assembled state of the connector, said raised elements engage the body of electroconductive material and the body of magnetic material, for the purpose of retaining it between the connection ends in the connector.

8. Coaxial connector according to claim 7, wherein the body of electroconductive material (20) comprises a strip-shaped conductor having elements (24) which are raised with respect to the plane of said conductor, for retention thereof in a duct (25) in the material (21) surrounding the electrical conductor.

9. Coaxial connector according to claim 7, wherein the raised elements are lip-shaped, each having a fixed resilient end and a raised free end, which free end in the assembled state engages the body in question, preferably in guide slots or guide grooves formed for receiving therein the lip-shaped elements.

10. Coaxial connector according to claim 1, provided with a casing (1) of electrically insulating material, further comprising plug and/or socket contact elements (2) accommodated in the casing.

11. Method of assembling a coaxial connector, said connector comprising a casing (1) of electrically insulating material provided with at least one electrical contact element (2) having a contact side (3) in the form of a coaxial inner and outer contact member (11, 6) for making contact with a further connector, a connection side (4) in the form of connection ends (18, 19), which extend from the inner and outer contact member, for connecting electrical wiring and a body (20) which is made of electroconductive and/or magnetic material and extends in the casing between the connection ends, wherein the body of electroconductive material (20) is provided with connection means for connecting further electrical wiring, the body being disposed in a first step between the connection ends of said contact members, and in a further step the assembly, thus formed, of contact members and body being accommodated from the connection side in the casing of the connector.

12. Coaxial connector provided with at least one electrical contact element having a contact side in the form of a coaxial inner and outer contact member for making contact with a further connector, and having a connection side in the form of connection ends, which extend from the inner and outer contact member, for connecting electrical wiring, there is disposed in the connector a body of electroconductive material which extends between the connection ends and is electrically separated therefrom and there is a jacket of magnetic material which extends between the connection ends and is electrically separated therefrom and said jacket is integral with and surrounds the body of electroconductive material.

* * * * *

UNITED STATES PATENT AND TRADEMARK OFFICE

CERTIFICATE OF CORRECTION

PATENT NO. : 5,839,910

DATED : Nov. 24, 1998

INVENTOR(S) : Meller et al.

Figure 6B:
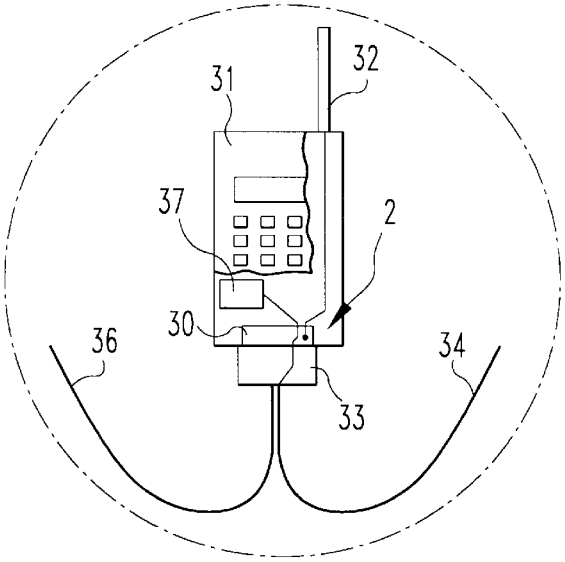
FIG. 6 shows, in diagrammatic form, a field of application of the coaxial connector according to the invention, in particular the embodiment thereof depicted in FIGS. 4 and 5.
Figure 6A:
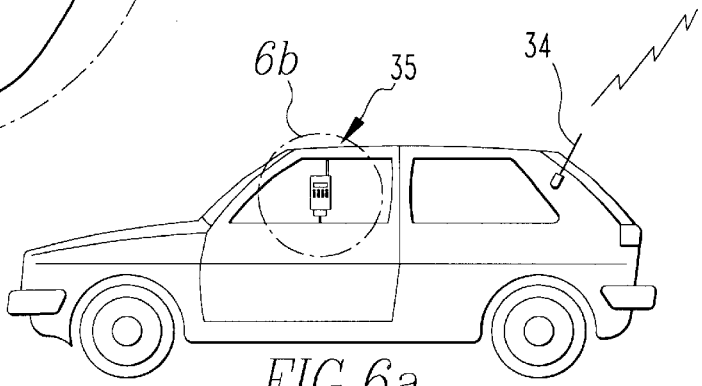

It is certified that error appears in the above-identified patent and that said Letters Patent is hereby corrected as shown below:

Column 4, line 29, delete "Fig. 6" and substitute --Figure 6a--.

Column 4, line 32, between "5" and the period, insert --and Figure 6b is an enlarged view of circle 6b in Figure 6a--.

Signed and Sealed this

Eighth Day of June, 1999

*Attest:*

Q. TODD DICKINSON

*Attesting Officer*

*Acting Commissioner of Patents and Trademarks*